US008945372B2

(12) United States Patent
Dindi et al.

(10) Patent No.: US 8,945,372 B2
(45) Date of Patent: Feb. 3, 2015

(54) TWO PHASE HYDROPROCESSING PROCESS AS PRETREATMENT FOR TREE-PHASE HYDROPROCESSING PROCESS

(75) Inventors: Hasan Dindi, Wilmington, DE (US); Luis Eduardo Murillo, Wilmington, DE (US); Thanh Gia Ta, Newark, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 811 days.

(21) Appl. No.: 13/233,093

(22) Filed: Sep. 15, 2011

(65) Prior Publication Data

US 2013/0068657 A1 Mar. 21, 2013

(51) Int. Cl.

| | |
|---|---|
| ***C10G 65/12*** | (2006.01) |
| ***C10G 47/06*** | (2006.01) |
| ***C10G 45/02*** | (2006.01) |
| ***C10G 47/34*** | (2006.01) |
| ***C10G 65/02*** | (2006.01) |

(52) U.S. Cl.

CPC ..... *C10G 47/34* (2013.01); *C10G 65/02* (2013.01); *C10G 2300/42* (2013.01); *C10G 2300/1048* (2013.01); *C10G 2300/4081* (2013.01); *C10G 2300/802* (2013.01)

USPC ..... 208/59; 208/89; 208/97; 208/210; 208/254 H

(58) Field of Classification Search

USPC ..... 208/59, 89, 97, 210, 254 H

See application file for complete search history.

(56) References Cited

U.S. PATENT DOCUMENTS

| | | | |
|---|---|---|---|
| 3,297,563 | A | 1/1967 | Doumani |
| 3,328,289 | A | 6/1967 | Streed |
| 3,328,290 | A | 6/1967 | Hengstebeck |
| 3,714,031 | A | 1/1973 | Ouwerkerk et al. |
| 3,841,996 | A | 10/1974 | Jacobsen |
| 4,648,959 | A | 3/1987 | Herber et al. |
| 4,775,460 | A | 10/1988 | Reno |
| 5,294,328 | A | 3/1994 | Schmidt et al. |

(Continued)

FOREIGN PATENT DOCUMENTS

| | | | |
|---|---|---|---|
| WO | 03086567 | A1 | 10/2003 |
| WO | 2004078656 | A2 | 9/2004 |

(Continued)

OTHER PUBLICATIONS

M. Herskowitz and J. M. Smith, Trickle-Bed Reactors; A Review, AIChe Journal, vol. 29, No. 1, Jan. 1983, pp. 1-18.

(Continued)

*Primary Examiner* — Randy Boyer

(57) ABSTRACT

The present invention provides a process for hydroprocessing comprising treating a hydrocarbon feed in a first two-phase hydroprocessing zone having a liquid recycle, producing product effluent, which is contacted with a catalyst and hydrogen in a downstream three-phase hydroprocessing zone, wherein at least a portion of the hydrogen supplied to the three-phase zone is a hydrogen-rich recycle gas stream. Optionally, the product effluent from the first two-phase hydroprocessing zone is fed to a second two-phase hydroprocessing zone containing a single-liquid-pass reactor. The two-phase hydroprocessing zones comprise two or more catalyst beds disposed in liquid-full reactors. The three-phase hydroprocessing zone comprises one or more single-liquid-pass catalyst beds disposed in a trickle bed reactor.

20 Claims, 1 Drawing Sheet

(56) References Cited

U.S. PATENT DOCUMENTS

| | | | | |
|---|---|---|---|---|
| 5,675,048 | A | 10/1997 | Zhang et al. | |
| 6,017,443 | A * | 1/2000 | Buchanan | 208/59 |
| 6,123,835 | A | 9/2000 | Ackerson et al. | |
| 6,500,329 | B2 | 12/2002 | Tsao et al. | |
| 7,238,275 | B2 | 7/2007 | Stupin et al. | |
| 7,313,911 | B2 | 1/2008 | Pfeifer et al. | |
| 7,345,211 | B2 | 3/2008 | Espinoza et al. | |
| 7,431,831 | B2 | 10/2008 | Farshid et al. | |
| 7,622,034 | B1 | 11/2009 | Thakkar et al. | |
| 7,794,585 | B2 | 9/2010 | Leonard et al. | |
| 7,799,208 | B2 | 9/2010 | Kokayeff et al. | |
| 7,951,290 | B2 | 5/2011 | Thakkar et al. | |
| 2004/0017350 | A1 | 1/2004 | Yoon | |
| 2004/0173501 | A1 | 9/2004 | Lawson et al. | |
| 2005/0145544 | A1 | 7/2005 | Lawson et al. | |
| 2006/0016722 | A1 | 1/2006 | Espinoza et al. | |
| 2007/0132991 | A1 | 6/2007 | Alspach et al. | |
| 2008/0196764 | A1 | 8/2008 | Newton | |
| 2009/0095656 | A1 | 4/2009 | Kokayeff et al. | |
| 2009/0321310 | A1 * | 12/2009 | Kokayeff et al. | 208/49 |
| 2009/0321319 | A1 | 12/2009 | Kokayeff et al. | |
| 2009/0326289 | A1 | 12/2009 | Petri et al. | |
| 2010/0021357 | A1 | 1/2010 | Kalnes et al. | |
| 2010/0155294 | A1 | 6/2010 | Kokayeff et al. | |
| 2010/0176028 | A1 | 7/2010 | Kokayeff | |
| 2010/0303691 | A1 | 12/2010 | Corradi et al. | |
| 2010/0326884 | A1 * | 12/2010 | Petri et al. | 208/59 |
| 2010/0329942 | A1 | 12/2010 | Petri et al. | |
| 2011/0011094 | A1 | 1/2011 | Hedrick | |

FOREIGN PATENT DOCUMENTS

| | | | |
|---|---|---|---|
| WO | 2004099347 | A1 | 11/2004 |
| WO | 2006010068 | A1 | 1/2006 |

OTHER PUBLICATIONS

PCT International Search Report and Written Opinion dated Nov. 8, 2012.

Internal DuPont CR&D Search Report on Patentability for Full Liquid Technology as Pretreatment, Feb. 28, 2011.

* cited by examiner

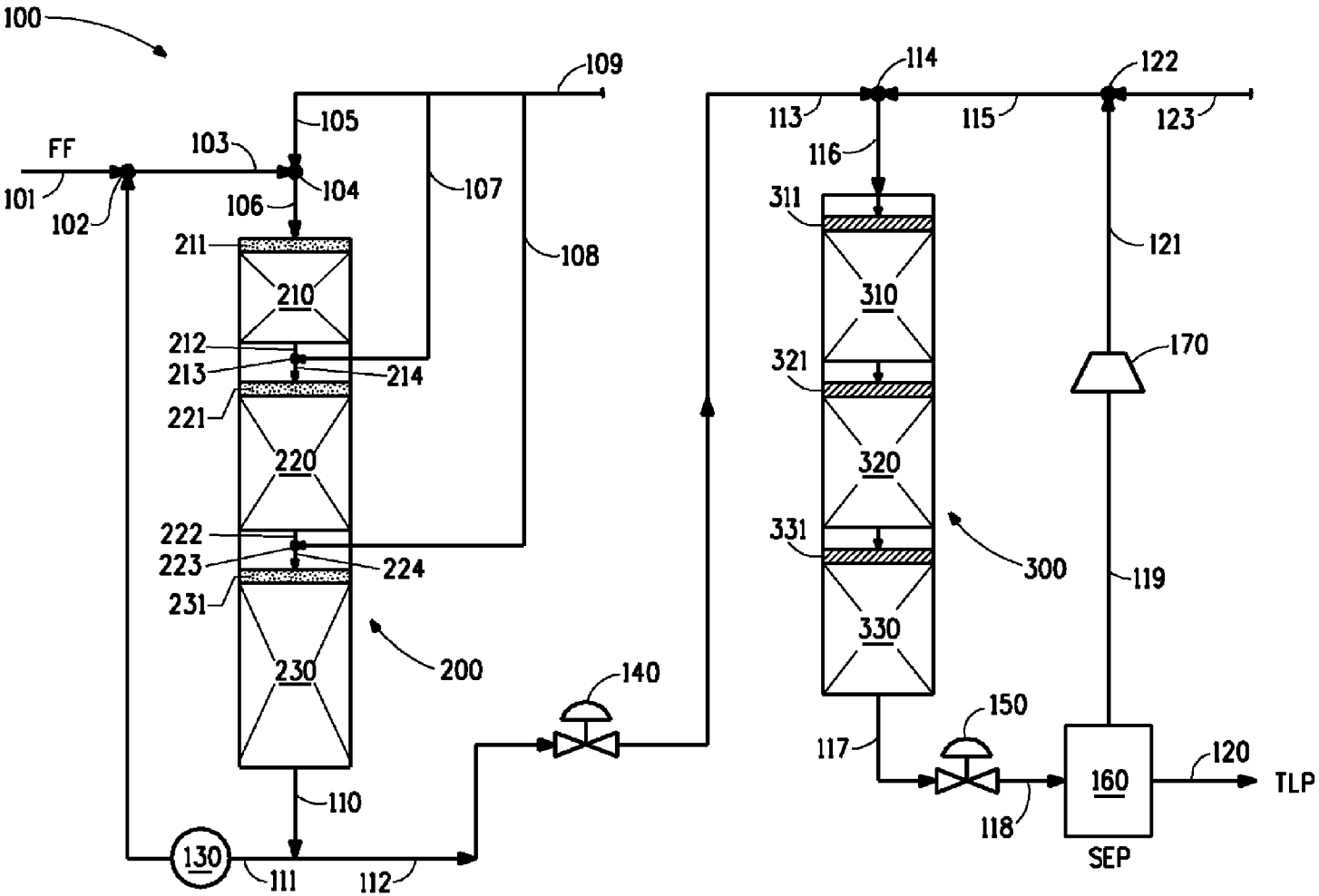
100
FF
101
102
103
104
105
106
107
108
109
110
111
112
113
114
115
116
117
118
119
120
121
122
123
TLP
SEP
160
170
150
140
130
200
210
211
212
213
214
220
221
222
223
224
230
231
300
310
311
320
321
330
331

TWO PHASE HYDROPROCESSING PROCESS AS PRETREATMENT FOR TREE-PHASE HYDROPROCESSING PROCESS

FIELD OF THE INVENTION

The present invention relates to a process for hydroprocessing hydrocarbon feeds using two reaction zones to remove contaminants and/or reduce undesirable compounds in the feed.

BACKGROUND OF THE INVENTION

Global demand for clean fuels, such as ultra-low-sulfur-diesel (ULSD), has risen quickly as many governments have enacted environmental regulations that require substantially lower sulfur levels for cleaner burning or simply "clean fuels", in order to reduce sulfur dioxide ($SO_2$) emissions from use of such fuels.

Hydroprocessing processes, such as hydrodesulfurization (HDS) and hydrodenitrogenation (HDN), which remove sulfur and nitrogen, respectively, have been used to treat hydrocarbon feeds to produce clean fuels.

Conventional three-phase hydroprocessing reactors, commonly known as trickle bed reactors, require transfer of hydrogen gas from the vapor phase through a liquid-phase hydrocarbon feed to react with the feed at the surface of a solid catalyst. Thus, three phases (gas, liquid and solid) are present. The continuous phase through the reactor is the gas phase. Trickle bed reactors can be expensive to operate. They require use of a large excess of hydrogen relative to the feed. Excess hydrogen is recycled through large compressors to avoid loss of the hydrogen value. In addition, significant coke formation causing catalyst deactivation has been an issue due to localized overheating as trickle bed operation can fail to effectively dissipate heat generated during hydroprocessing.

Ackerson et al. in U.S. Pat. No. 6,123,835, disclose a two-phase hydroprocessing system which eliminates the need to transfer hydrogen gas from the vapor phase through a liquid phase hydrocarbon to the surface of a solid catalyst. In the two-phase hydroprocessing system, a solvent, which may be a recycled portion of hydroprocessed liquid effluent, acts as diluent and is mixed with a hydrocarbon feed. Hydrogen is dissolved in the feed/diluent mixture to provide hydrogen in the liquid phase. Substantially all of the hydrogen required in the hydroprocessing reaction is available in solution.

Kokayeff et al. in U.S. Patent Application Publication No. 2009/0321310 disclose a process which combines a substantially liquid-phase (two-phase) hydroprocessing zone with a substantially three-phase hydroprocessing zone in a manner such that the hydrogen requirements for both reaction zones is provided from an external source to the three-phase zone. Kokayeff et al. defines "substantially liquid-phase" as including up to 5000 percent of saturation. The use of hydrogen recycle or a recycle gas compressor is considered unnecessary and can be eliminated. The effluent from the three-phase zone contains excess hydrogen and is directed to the liquid-phase zone, where the hydrogen present in the effluent satisfies the hydrogen requirement for the liquid phase reactions. To facilitate flow of hydrogen gas from the three-phase zone to the liquid-phase zone, Kokayeff et al. preferably operates the three-phase zone at a higher pressure than the liquid-phase zone.

While Kokayeff et al. seek to combine advantages of liquid-phase (two-phase) hydroprocessing with three-phase hydroprocessing, challenges remain due to effectiveness of the liquid-phase zone by relying on the three-phase zone for hydrogen. Conversion in the liquid-phase zone may be limited due to hydrogen solubility, so that substantial conversion may be needed in the three-phase zone, that is large reactor(s), to meet desired conversion.

It remains desirable to provide an efficient process for hydroprocessing hydrocarbon feeds, which provides a high conversion in terms of sulfur and nitrogen removal, density reduction, and cetane number increase. It is desirable to combine the economy of a liquid-phase process which may use smaller reactors with the effectiveness of a three-phase process which may provide high conversions in kinetically limited regions. It also remains desirable to have a hydroprocessing process to produce a product that meets a number of commercial transportation fuel requirements, including Euro V ULSD specifications.

SUMMARY OF THE INVENTION

The present invention provides a process for hydroprocessing hydrocarbon feeds. This process comprises:

(a) providing a hydroprocessing unit comprising a first two-phase hydroprocessing zone in sequence and in liquid communication with a three-phase hydroprocessing zone, wherein the first two-phase hydroprocessing zone comprises a liquid recycle and at least two catalyst beds disposed in sequence and in liquid communication, wherein each catalyst bed is disposed in a liquid-full reactor and contains a catalyst having a volume, the catalyst volume increasing in each succeeding bed; the three-phase hydroprocessing zone comprises a single-liquid pass catalyst bed disposed in a trickle bed reactor, wherein each single-liquid-pass catalyst bed is outside any liquid recycle stream;

(b) contacting a hydrocarbon feed with (i) a diluent and (ii) hydrogen to produce a hydrocarbon feed/diluent/hydrogen mixture upstream of the two-phase hydroprocessing zone, wherein hydrogen dissolves in the mixture to provide a liquid feed;

(c) contacting the liquid feed with a first catalyst in a first catalyst bed of the two-phase hydroprocessing zone to produce a product effluent;

(d) contacting the product effluent from a preceding catalyst bed with a current catalyst in a current catalyst bed of the first two-phase hydroprocessing zone, wherein the preceding catalyst bed is immediately upstream of and in liquid communication with the current catalyst bed to produce a current product effluent, such that when the preceding catalyst bed is the first catalyst bed, the product effluent from a preceding catalyst bed is the product effluent from the first catalyst bed produced in step (c);

(e) recycling a portion of the current product effluent from a final catalyst bed of the two-phase hydroprocessing zone as liquid recycle for use in the diluent in step (b) at a recycle ratio of from about 0.1 to about 10, preferably from about 0.5 to about 6, more preferably from about 1 to about 3, wherein the final catalyst bed contains a final catalyst and is a current catalyst bed having no succeeding (downstream) catalyst bed in the first two-phase hydroprocessing zone;

(f) contacting hydrogen and the remaining portion of the current product effluent from the final catalyst bed of the first two-phase hydroprocessing zone with one or more catalysts in one or more single-liquid-pass catalyst beds, wherein each single-liquid-pass catalyst bed in this step (f) is disposed in (i) a liquid-full reactor in a second two-phase hydroprocessing zone or (ii) a trickle bed reactor in the three-phase hydroprocessing zone to produce a product effluent, provided that when the remaining portion of the current product effluent is contacted with a catalyst in a single-liquid-pass catalyst bed disposed in a liquid-full reactor, there is a further step comprising:

(f') contacting the product effluent from the single-liquid-pass catalyst bed disposed in a liquid-full reactor and a hydrogen-containing gas with a catalyst in a single-liquid-pass catalyst bed disposed in a trickle bed reactor in the three-phase hydroprocessing zone;

and further provided that when the single-liquid-pass catalyst bed is disposed in a trickle bed reactor, the hydrogen is provided as a hydrogen-containing gas wherein at least a portion of the hydrogen-containing gas is a hydrogen-rich recycle gas stream and wherein the hydrogen-containing gas is added in an amount sufficient to maintain a continuous gas phase in the trickle bed reactor and the product effluent is a trickle bed product effluent; and (g) directing the trickle bed product effluent to a separator to produce the hydrogen-rich recycle gas stream for use in step (f) and a liquid product.

Optionally, the process of the present invention further comprises repeating step (d) one or more times. For example, step (d) is performed one to nine times (that is, step (d) is repeated zero to eight times), so that the first two-phase hydroprocessing zone has a total of two to ten beds. When step (d) is repeated one time, this two-phase hydroprocessing zone contains three catalyst beds: a first catalyst bed, a second catalyst bed and a final catalyst bed. Accordingly, the second and final catalyst beds are "current catalyst beds" in step (d). In a series of catalyst beds, each catalyst bed succeeding the first catalyst bed, that is each catalyst bed downstream of the first catalyst bed, is a current catalyst bed in step (d).

In one option of the process of this invention, step (d) is not repeated and the first two-phase hydroprocessing zone contains only two catalyst beds—a first catalyst bed and a final catalyst bed.

As set forth herein, catalyst beds are arranged in sequence. Thus, a first catalyst bed has no preceding catalyst bed (no catalyst bed is upstream of the first catalyst bed) and a final catalyst bed has no succeeding catalyst bed (no catalyst bed downstream of the final catalyst bed). Thus, the first two-phase hydroprocessing zone contains at least a first catalyst bed and a final catalyst bed, or at least one preceding catalyst bed and at least one succeeding catalyst bed.

The three-phase hydroprocessing zone comprises a single-liquid pass catalyst bed disposed in a trickle bed reactor. It is contemplated herein that the three-phase hydroprocessing zone may comprise two or more single-liquid pass catalyst bed disposed in one or more trickle bed reactors. For example, this zone may consist of one single-liquid pass catalyst bed disposed in a trickle bed reactor. This zone may comprise two or more single-liquid pass catalyst beds disposed in one or more trickle bed reactors, wherein the two or more individual beds may be arranged in a single column trickle bed reactor or individual beds may be arranged in separate trickle bed reactors.

BRIEF DESCRIPTION OF THE FIGURE

FIG. 1 is a flow diagram illustrating one embodiment of the process of this invention to pretreat a hydrocarbon feed in a two-phase hydroprocessing zone prior to hydroprocessing the pretreated feed in a three-phase hydroprocessing zone.

DETAILED DESCRIPTION OF THE INVENTION

The present invention provides a process for hydroprocessing hydrocarbon feeds. The process provides a high overall conversion in terms of sulfur and nitrogen removal, density reduction, and cetane number increase. Using the process of this invention, the sulfur content of typical hydrocarbon feeds, which can be in excess of 10,000 wppm by weight (wppm), can be reduced, for example, to 7 wppm or 8 wppm, which meets the Euro V specifications (<10 wppm) for ultra-low-sulfur-diesel (ULSD).

In the process of the present invention, the first two-phase hydroprocessing zone comprises at least two catalyst beds. By "two-phase hydroprocessing zone", it is meant herein that the catalyst added in the process is in the solid phase and the reactants (feed, hydrogen) as well as diluent and product effluents are in the liquid phase. Each reactor of a two-phase hydroprocessing zone operates as a liquid-full reactor, in which hydrogen dissolves in the liquid phase and the reactor is substantially free of a gas phase.

An upper limit of the number of beds in the first two-phase hydroprocessing zone may be based on practical reasons such as controlling cost and complexity in this hydroprocessing zone. Two or more catalyst beds are used in this two-phase hydroprocessing zone, for example two to ten beds (repeat step (d) zero to eight times), or two to four beds (repeat step (d) zero to two times). For each succeeding bed in this zone, catalyst volume increases.

Two catalyst beds may be present in the first two-phase hydroprocessing zone of the present invention. The catalyst volume of the first catalyst bed is smaller than the catalyst volume of the second catalyst bed. The first product effluent from the first catalyst bed is directed to the second catalyst bed, which is the final catalyst bed. A portion of the product effluent from the final catalyst bed is recycled as liquid recycle for use in the diluent.

When more than two beds are present in the first two-phase hydroprocessing zone, step (d) is repeated one or more times. The term "current catalyst bed" as used herein means the particular catalyst bed in which contacting step (d) is occurring. As used herein, the current catalyst bed succeeds (is downstream of) the first catalyst bed, and thus each "current catalyst bed" has at least one preceding catalyst bed. When the current catalyst bed is the second catalyst bed in sequence, the first catalyst bed is the immediately preceding catalyst bed.

One skilled in the art will understand the relationships between the first catalyst bed, having no preceding (upstream) catalyst bed, a current catalyst bed, which has at least one preceding catalyst bed and the final catalyst bed, which has no succeeding (downstream) catalyst bed and is a current catalyst bed in step (d).

Preferably, each catalyst bed of the first two-phase hydroprocessing zone consumes about the same amount (by volume) of hydrogen. A ratio of the volume of the first catalyst (catalyst in the first catalyst bed) to the volume of the final catalyst (catalyst in the final catalyst bed) in the first two-phase hydroprocessing zone is preferably in the range of about 1:1.1 to about 1:20, preferably 1:1.1 to 10. In a preferred embodiment, catalyst volume is distributed among the catalyst beds of this hydroprocessing zone in a way such that the hydrogen consumption for each catalyst bed is essentially equal. By "essentially equal", it is meant herein that substantially the same amount of hydrogen is consumed in each catalyst bed, within a range of ±10% by volume of hydrogen. One skilled in the art of hydroprocessing will be able to determine catalyst volume distribution to achieve desired hydrogen consumption in these catalysts beds.

The catalyst beds in the first two-phase hydroprocessing zone of the present invention may be arranged in a single column reactor having multiple individual beds so long as the beds are distinct and separated. Alternatively, multiple reactors may be used having one or more beds in each individual reactor.

In the first two-phase hydroprocessing zone, fresh hydrogen is added into the liquid feed/diluent/hydrogen mixture in advance of the first catalyst bed and preferably into the product effluent from a preceding catalyst bed before contacting the effluent with a current catalyst bed. By "fresh hydrogen", it is meant herein that the hydrogen is not produced from a recycle stream. The fresh hydrogen dissolves in the mixture or product effluent prior to contacting the mixture, which is the liquid feed, or product effluent, with the catalyst in the catalyst bed.

In the process of this invention, a hydrocarbon feed is contacted with a diluent and hydrogen gas in advance of the first catalyst bed of the first two-phase hydroprocessing zone. The hydrocarbon feed may be contacted first with hydrogen and then with the diluent, or preferably, first with the diluent and then with hydrogen to provide a feed/diluent/hydrogen mixture, which is the liquid feed. The liquid feed is contacted with a first catalyst in a first catalyst bed to produce a first product effluent.

The hydrocarbon feed may be any hydrocarbon composition containing undesirable amounts of contaminants (sulfur, nitrogen, metals) and/or aromatics. The hydrocarbon feed may have a viscosity of at least 0.5 cP, a density of at least 750 $kg/m^3$ at temperature of 15.6° C. (60° F.), and an end boiling point in the range of from about 350° C. (660° F.) to about 700° C. (1300° F.). The hydrocarbon feed may be mineral oil, synthetic oil, petroleum fractions, or combinations of two or more thereof. Petroleum fractions may be grouped into three main categories as (a) light distillates, such as liquefied petroleum gas (LPG), gasoline, naphtha; (b) middle distillates, such as, kerosene, diesel; and (c) heavy distillates and residuum, such as heavy fuel oil, lubricating oils, wax, asphalt. These classifications are based on general processes for distilling crude oil and separating into fractions (distillates).

A preferred hydrocarbon feed is selected from the group consisting of jet fuel, kerosene, straight run diesel, light cycle oil, light coker gas oil, gas oil, heavy cycle oil, heavy coker gas oil, heavy gas oil, resid, deasphalted oil, waxes, lubes and combinations of two or more thereof.

Another preferred hydrocarbon feed is a middle distillate blend, which is a mixture of two or more middle distillates, for example, straight run diesel and light cycle oil. By "middle distillates", it is meant the collective petroleum distillation fraction boiling above naphtha (boiling point above about 300° F. or 149° C.) and below residue oil (boiling point above about 800° F. or 427° C.). Middle distillates may be marketed as kerosene, jet fuel, diesel fuel and fuel oils (heating oils).

Preferably, in the first two-phase hydroprocessing zone, a product effluent from a preceding catalyst bed is contacted with fresh hydrogen before the product effluent is contacted with the catalyst in a current catalyst bed. Thus, hydrogen is preferably added between beds to increase hydrogen content in the product effluent and thus produce a product effluent/hydrogen liquid. Hydrogen may be mixed and/or flashed with product effluent, to produce the product effluent/hydrogen liquid.

A two-phase hydroprocessing zone is a liquid-full reaction zone having substantially no gas phase hydrogen. By "substantially no gas phase hydrogen", it is meant herein that no more than 5%, preferably no more than 1% or preferably 0% hydrogen is present in the gas phase. Excess hydrogen gas may be removed from the liquid feed or the product effluent/hydrogen liquid prior to feeding to a catalyst bed to maintain the process as a liquid-full process.

The diluent used in this invention typically comprises, consists essentially of, or consists of a recycle stream of the product effluent from the final catalyst bed in the two-phase hydroprocessing zone. The recycle stream is a liquid recycle and is a portion of the product effluent from the final catalyst bed that is recycled and combined with the hydrocarbon feed before or after contacting the hydrocarbon feed with hydrogen. Preferably the hydrocarbon feed is contacted with the diluent before contacting the hydrocarbon feed with hydrogen.

In addition to the recycled product effluent, the diluent may further comprise any organic liquid that is compatible with the hydrocarbon feed and catalysts. When the diluent comprises an organic liquid, preferably the organic liquid is a liquid in which hydrogen has a relatively high solubility. The diluent may comprise an organic liquid selected from the group consisting of light hydrocarbons, light distillates, naphtha, diesel and combinations of two or more thereof. More particularly, the organic liquid is selected from the group consisting of propane, butane, pentane, hexane or combinations thereof.

The diluent is typically present in an amount of no greater than 90%, based on the total weight of the feed and diluent, preferably 20-85%, and more preferably 50-80%. Preferably, the diluent consists of recycled product stream, which may comprise dissolved light hydrocarbons, such as propane, butane, pentane, hexane, or combinations of two or more thereof.

A portion of the product effluent from the final catalyst bed of the first two-phase hydroprocessing zone is recycled as a recycle stream for use in the diluent at a recycle ratio of from about 0.1 to about 10, preferably from about 0.5 to about 6, more preferably from about 1 to about 3. Recycle ratios correlate with the amount of added diluent (percent by weight of feed and diluent) set forth hereinabove. The recycle stream is combined with fresh hydrocarbon feed without separating ammonia and hydrogen sulfide and remaining hydrogen from the final product effluent.

The combination of hydrocarbon feed and diluent is capable of dissolving all of the hydrogen in the liquid phase, without need for hydrogen in the gas phase in a two-phase hydroprocessing zone. That is, both the first and optional second two-phase hydroprocessing zones operate as liquid-full processes. By "liquid-full process", it is meant herein that the hydrogen is substantially dissolved in liquid, i.e., substantially no gas phase hydrogen.

The first two-phase hydroprocessing zone is in sequence with and in liquid communication with a three-phase hydroprocessing zone. Optionally, the liquid communication between the first two-phase hydroprocessing zone is interrupted by a second two-phase hydroprocessing zone. The optional second two-phase hydroprocessing zone succeeds (is downstream of) and is in liquid communication with the first two-phase hydroprocessing zone and precedes (is upstream of) and is in liquid communication with the three phase hydroprocessing zone as described hereinbelow.

Hydrogen and the remaining portion of the current product effluent from the final catalyst bed of the first two-phase hydroprocessing zone are contacted with one or more catalysts in one or more single-liquid-pass catalyst beds, wherein each single-liquid-pass catalyst bed in this step is disposed in (i) a liquid-full reactor in a second two-phase hydroprocessing zone or (ii) a trickle bed reactor in the three-phase hydroprocessing zone to produce a product effluent. By "single-liquid-pass catalyst bed" it meant that there is no recycle of liquid phase of the product effluent from a single-liquid-pass catalyst bed to a preceding (upstream) catalyst bed.

In a first embodiment, a single-liquid-pass catalyst bed is disposed in a trickle bed reactor and the product effluent is a trickle bed product effluent. In this embodiment, the three-phase hydroprocessing zone contains the single-liquid-pass catalyst bed. Further, the hydrogen is provided as a hydrogen-containing gas wherein at least a portion of the hydrogen-containing gas is a hydrogen-rich recycle gas stream subsequently produced after separating liquid product from the trickle bed product effluent. The hydrogen-containing gas is added in an amount sufficient to maintain a continuous gas phase in the trickle bed reactor.

The term "trickle bed reactor" is used herein to mean a reactor in which both liquid and gas streams pass through a packed bed of solid catalyst particles, and the gas phase is the continuous phase.

By reciting "a single-liquid-pass catalyst bed" is meant herein to be understood that one or more single-liquid-pass catalyst beds may be used provided the beds are in sequence and in liquid communication such that for a current bed, the effluent of a preceding bed is contacted with the catalyst in the current bed. Thus, two or more single-liquid pass catalyst beds disposed in a trickle bed reactor are contemplated herein. No recycle of the liquid component of the effluent from a bed is recycled to preceding (upstream) bed in the process.

When the three-phase hydroprocessing zone comprises more than one single-liquid-pass catalyst bed, the beds may be arranged in a single column reactor so long as the beds are distinct and separated. Alternatively, multiple trickle bed reactors may be used having one or more single-liquid-pass catalyst beds in each individual reactor.

In the event the three-phase hydroprocessing zone has more than one single-liquid-pass catalyst bed, the beds are arranged in sequence similar to those in the first two-phase hydroprocessing zone. There is at least a first single-liquid-pass catalyst bed and a final single-liquid-pass catalyst bed disposed in a trickle bed reactor. Such first single-liquid-pass catalyst bed has no preceding (upstream) single-liquid-pass catalyst bed and the final single-liquid-pass catalyst bed has no succeeding (downstream) single-liquid-pass catalyst bed, with each of the beds disposed in a trickle bed reactor. The trickle bed product effluent is the effluent from the final single-liquid-pass catalyst bed in the three-phase hydroprocessing zone.

In a second embodiment, a single-liquid-pass catalyst bed is disposed in a liquid-full reactor in a second two-phase hydroprocessing zone succeeding the first two-phase hydroprocessing zone and preceding the three-phase hydroprocessing zone. Preferably, the catalyst volume in a single-liquid-pass catalyst bed in a liquid-full reactor in the second two-phase hydroprocessing zone is smaller than the catalyst volume in the final catalyst bed of the preceding two-phase hydroprocessing zone.

In this second embodiment, the process further comprises contacting a hydrogen-containing gas and the product effluent from the single-liquid-pass catalyst bed disposed in a liquid-full reactor with a catalyst in a single-liquid-pass catalyst bed disposed in a trickle bed reactor in the three-phase hydroprocessing zone to produce a trickle bed product effluent, wherein at least a portion of the hydrogen-containing gas is a hydrogen-rich recycle gas stream and wherein the hydrogen-containing gas is added in an amount sufficient to maintain a continuous gas phase in the trickle bed reactor. This latter step is performed as recited hereinabove with respect to the first embodiment.

Preferably, in both the first and second embodiments as described hereinabove, the remaining portion of the current product effluent from the final catalyst bed of the two-phase hydroprocessing zone is mixed with the hydrogen-containing gas to prior to contacting with the catalyst in the single-liquid-pass catalyst bed to produce a liquid feed or a combined liquid/gas feed depending on whether the catalyst bed is disposed in a liquid-full reactor or the catalyst bed is disposed in a trickle bed reactor, respectively. After this mixing step, the resulting combined feed is directed to the single-liquid-pass catalyst bed to produce the product effluent.

Each reactor of the hydroprocessing zones is a fixed bed reactor and may be of a tubular design packed with a solid catalyst (i.e. a packed bed reactor).

Hydrogen is fed separately to the two-phase and three-phase hydroprocessing zones. The total amount of hydrogen fed to the two-phase hydroprocessing zone is from about 17.81 l/l (100 scf/bbl) to about 445.25 l/l (2500 scf/bbl), and the total amount of hydrogen fed to the three-phase hydroprocessing zone is from about 89.05 l/l (500 scf/bbl) to about 890.5 l/l (5000 scf/bbl).

Any catalyst bed in the first two-phase hydroprocessing zone, the second two-phase hydroprocessing zone or the three-phase hydroprocessing zone may have a distribution zone located above and attached to each catalyst bed. The feed (liquid or combined liquid/gas) may be introduced into a distribution zone above a catalyst bed, prior to contacting the liquid feed with the catalyst. Product effluent from a preceding catalyst bed may be introduced into a distribution zone above a current catalyst bed.

In the two-phase hydroprocessing zones, a distribution zone may assist dissolution of added hydrogen gas between catalyst beds in the product effluent from a preceding catalyst bed. In addition a distribution zone may assist with distribution of the liquid feed or product effluent/hydrogen liquid across the catalyst bed.

In the three-phase hydroprocessing zone, a distribution zone located above and attached to each catalyst beds may assist in distribution of the liquid and gas fed to the bed across the catalyst.

A distribution zone may be as simple as a distribution of inert material above the bed, such as glass beads as illustrated in the Examples.

The flow of the liquid through the first or second two-phase hydroprocessing zone may be in a downflow mode. Alternatively, the flow of the liquid through the first or second two-phase hydroprocessing zone may be in an upflow mode.

The flow of both gas and liquid through the three-phase hydroprocessing zone may be in a downflow mode. Alternatively, the flow of both gas and liquid through the three-phase hydroprocessing zone may be in an upflow mode. In another alternative, the flow of the gas may be countercurrent to the flow of liquid through the three-phase hydroprocessing zone. In the latter alternative, the flow of gas may be upflow or downflow, preferably upflow.

In step (g) of the process of this invention, the trickle bed product effluent from the final single-liquid-pass catalyst bed of the three-phase hydroprocessing zone is directed to a separator to produce a hydrogen-rich recycle gas stream and a liquid product. The liquid product is referred to herein as Total Liquid Product (TLP). The liquid product may be suitable for a number of uses, including as a component of clean fuels having low sulfur and nitrogen and high cetane number.

The process of this invention is performed at elevated temperatures and pressures. Each catalyst bed of the two-phase hydroprocessing zones has a temperature from about 200° C. to about 450° C., preferably from about 250° C. to about 400°

C., more preferably from about 340° C. to about 390° C., and a hydrocarbon feed rate to provide a liquid hourly space velocity of from about 0.1 to about 10 $hr^{-1}$, preferably about 0.4 to about 8.0 $hr^{-1}$, more preferably about 0.4 to about 6.0 $hr^{-1}$. Each catalyst bed of the two-phase hydroprocessing zones has a pressure from about 3.45 MPa (34.5 bar) to about 17.3 MPa (173 bar).

Each catalyst bed of the three-phase hydroprocessing zone has a temperature from about 200° C. to about 450° C., preferably from about 250° C. to about 400° C., more preferably from about 340° C. to about 390° C. Each catalyst bed of the three-phase hydroprocessing zone has a pressure from about 2.1 MPa (21 bar) to about 17.3 MPa (173 bar).

Preferably, the two-phase hydroprocessing zones operate at the same or at a slightly higher pressure than the pressure of the three-phase hydroprocessing zone. A slight pressure difference between the two-phase and three-phase hydroprocessing zones, with higher pressure in the two-phase zones is beneficial for several reasons, such as to accommodate the pressure drop across the two-phase zones.

Each catalyst bed of this invention contains a catalyst, which is a hydrotreating catalyst or hydrocracking catalyst. By "hydrotreating", it is meant herein a process in which a hydrocarbon feed reacts with hydrogen for the removal of heteroatoms, such as sulfur, nitrogen, oxygen, metals and combinations thereof, or for hydrogenation of olefins and/or aromatics, in the presence of a hydrotreating catalyst. By "hydrocracking", it is meant herein a process in which a hydrocarbon feed reacts with hydrogen for the breaking of carbon-carbon bonds to form hydrocarbons of lower average boiling point and lower average molecular weight than the starting average boiling point and average molecular weight of the hydrocarbon feed, in the presence of a hydrocracking catalyst.

In one embodiment, at least one catalyst of the two-phase hydroprocessing zone is a hydrotreating catalyst. In another embodiment, at least one catalyst of the two-phase hydroprocessing zone is a hydrocracking catalyst.

In one embodiment, at least one catalyst of the three-phase hydroprocessing zone is a hydrotreating catalyst. In another embodiment, at least one catalyst of the three-phase hydroprocessing zone is a hydrocracking catalyst.

A hydrotreating catalyst comprises a metal and an oxide support. The metal is a non-precious metal selected from the group consisting of nickel, cobalt, and combinations thereof, preferably combined with molybdenum and/or tungsten. The hydrotreating catalyst support is a mono- or mixed-metal oxide, preferably selected from the group consisting of alumina, silica, titania, zirconia, kieselguhr, silica-alumina and combinations of two or more thereof.

A hydrocracking catalyst also comprises a metal and an oxide support. The metal is also a non-precious metal selected from the group consisting of nickel, cobalt, and combinations thereof, preferably combined with molybdenum and/or tungsten. The hydrocracking catalyst support is a zeolite, amorphous silica, or a combination thereof.

Preferably, the catalysts for use in both the two phase and the three-phase hydroprocessing zones of the present invention comprise a combination of metals selected from the group consisting of nickel-molybdenum (NiMo), cobalt-molybdenum (CoMo), nickel-tungsten (NiW) and cobalt-tungsten (CoW) and combinations thereof.

Catalysts for use in the present invention may further comprise other materials including carbon, such as activated charcoal, graphite, and fibril nanotube carbon, as well as calcium carbonate, calcium silicate and barium sulfate.

Catalysts for use in the present invention include known commercially available hydroprocessing catalysts. Although the metals and supports may be similar or the same, catalyst manufacturers have the knowledge and experience to provide of formulations for either hydrotreating catalysts or hydrocracking catalysts.

It is within the scope of the present invention that more than one type of hydroprocessing catalyst may be used in the two-phase hydroprocessing zone and/or in the three-phase hydroprocessing zone.

Preferably, the catalyst is in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts are commercially available.

The catalysts may be sulfided by contacting a catalyst with a sulfur-containing compound at an elevated temperature. Suitable sulfur-containing compound include thiols, sulfides, disulfides, $H_2S$, or combinations of two or more thereof. By "elevated temperature" it is meant, greater than 230° C. (450° F.) to 340° C. (650° F.). The catalyst may be sulfided before use ("pre-sulfiding") or during the process.

A catalyst may be pre-sulfided ex situ or in situ. A catalyst is pre-sulfided ex situ by contacting the catalyst with a sulfur-containing compound outside of a catalyst bed—that is, outside of the hydroprocessing unit comprising the two-phase and three-phase hydroprocessing zones. A catalyst is pre-sulfided in situ by contacting the catalyst with a sulfur-containing compound in a catalyst bed (i.e., within the hydroprocessing unit comprising the two-phase and three-phase hydroprocessing zones). Preferably, the catalysts of the two-phase and the three-phase hydroprocessing zones are pre-sulfided in situ.

A catalyst may be sulfided during the process by periodically contacting the feed or diluent with a sulfur-containing compound prior to contacting the liquid feed with the first catalyst.

In the process of this invention, organic nitrogen and organic sulfur are converted to ammonia and hydrogen sulfide, respectively, in one or more of the contacting steps (c), (d) and (f) of the process of the present invention. Notably, there is no separation of ammonia, hydrogen sulfide and remaining hydrogen from any product effluent from a preceding bed prior to feeding a product effluent to a current bed in the two-phase hydroprocessing zone. Ammonia and hydrogen sulfide produced in the process steps are dissolved in the product effluent. Surprisingly, despite the presence of ammonia and hydrogen sulfide, catalyst performance in both the two-phase and three-phase hydroprocessing zones is not substantially affected.

The process of the present invention combines the advantages of two different hydroprocessing processes: a two-phase hydroprocessing process based on liquid-full reactors and a three-phase hydroprocessing process based on trickle bed reactors. The two-phase hydroprocessing zone(s), which is (are) upstream of the three-phase hydroprocessing zone provides advantages of smaller size of the liquid full reactors and avoids hydrogen gas recirculation. The three-phase process, which operates using one or more single-liquid-pass catalyst beds in one or more trickle bed reactors, provides the advantage to convert sulfur in a kinetically limited region in contrast to a mass transfer limited region as understood by one skilled in the art. By "kinetically limited region", it is meant herein where organic sulfur concentration is low (such as around 10-100 wppm, after conversion from the two-phase zone(s)). The reaction rate of organic sulfur conversion is reduced, that is, kinetically limited, at such low sulfur concentrations, yet, when operated according to the process of this invention, conversion of sulfur to desirable levels is achieved. Such conversion is difficult to otherwise obtain in either liquid-full or trickle bed reactor operations alone.

Thus, the present invention provides an improved process for hydroprocessing hydrocarbon feeds using a first two-phase hydroprocessing zone or first and second two-phase hydroprocessing zones to pretreat a hydrocarbon feed upstream of a three-phase hydroprocessing zone. The process of the present invention creates a synergy for sulfur and nitrogen conversion that has not been achieved by either hydroprocessing zone alone or in known combinations. As a result of this invention, the sulfur content of hydrocarbon feeds can be reduced from greater than 10,000, for example, to 7 wppm or 8 wppm, thus meeting Euro V specifications (<10 wppm) for ultra-low-sulfur-diesel (ULSD). Advantageously even extremely "hard sulfur compounds," such as alkyl-substituted dibenzothiophenes, can be removed from a hydrocarbon feed using the process of this invention.

DETAILED DESCRIPTION OF THE FIGURE

FIG. 1 provides a process flow diagram for one embodiment of the hydroprocessing process of this invention. Certain detailed features of the process, such as pumps, compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or undue experimentation or invention.

FIG. 1 illustrates an integrated exemplary hydroprocessing unit 100. Fresh hydrocarbon feed (FF=fresh feed) 101 such as middle distillate is combined with recycle stream 111 for use as diluent from final catalyst bed 230 product effluent 110, through pump 130 at mixing point 102 to provide hydrocarbon feed/diluent 103. Hydrogen gas 105 is mixed with hydrocarbon feed/diluent 103 at mixing point 104 to provide hydrocarbon feed/diluent/hydrogen mixture 106. The hydrocarbon feed/diluent/hydrogen mixture 106 flows through distribution zone 211 into first catalyst bed 210.

Main hydrogen head 109 is the source for fresh hydrogen to all catalyst beds 210, 220 and 230 in the two-phase hydroprocessing zone. Catalyst beds 210, 220 and 230 are arranged in single two-phase column reactor 200.

First product effluent 212 from first catalyst bed 210 is mixed with fresh hydrogen gas 107 at mixing point 213 to provide second feed 214, which flows through distribution zone 221 to second catalyst bed 220.

Second product effluent 222 from second catalyst bed 220 is mixed with fresh hydrogen gas 108 at mixing point 223 to provide final feed 224, which flows through distribution zone 231 to third catalyst bed 230.

Final product effluent 110 from final catalyst bed 230 is split. A portion of final product effluent 110 is returned to first catalyst bed 210 as recycle stream 111 through pump 130 to mixing point 102. The ratio of recycle stream 111 to fresh hydrocarbon feed 101 is between 0.1 and 10 (the recycle ratio).

The remaining portion 112 of final product effluent 110 from the third catalyst bed 230 flows through control valve 140 to provide effluent feed 113, which is mixed with hydrogen-containing gas 115 at mixing point 114 to provide combined liquid/gas feed 116, which flows through distribution zone 311 to first single-liquid-pass catalyst bed 310 and continues to flow through distribution zone 321 to second single-liquid-pass catalyst bed 320 and continues to flow through distribution zone 331 to final single-liquid-pass catalyst bed 330 for further hydrotreating and/or hydrocracking to produce trickle bed product effluent 117. Catalyst beds 310, 320 and 330 are provided in single three-phase column reactor 300.

Hydrogen gas 123 is mixed with hydrogen-rich recycle gas stream 121 from compressor 170 at mixing point 122 to provide hydrogen-containing gas 115. Trickle bed product effluent 117 from catalyst bed 330 flows through control valve 150 to provide a lower pressure-reduced product effluent 118, which is fed to separator 160 (SEP) to be flashed, cooled and separated into total liquid product 120 (TLP) and recycle gas stream 119 which flows through compressor 170 to provide hydrogen-rich recycle gas stream 121. Although not illustrated in FIG. 1, hydrogen-rich gas stream 121 is cooled to separate any condensate, then scrubbed of $H_2S$ and $NH_3$ and thereafter combined with hydrogen gas 123 at mixing point 122 and recycled to the three-phase reactor 300.

Total liquid product 120 may be further fractioned (distilled), for example, to separate a lighter fraction from a heavier fraction, and to provide a variety of products, such as kerosene, jet fuel, diesel fuel and fuel oils. Such fractionation (distillation) process steps are not illustrated.

Liquid flow (feed, diluent, which includes recycle stream, and hydrogen) in FIG. 1 is illustrated as downflow through all catalyst beds 210, 220, 230, 310, 320 and 330. As shown in FIG. 1, the feed/diluent/hydrogen mixture 106 and product effluents/feeds 212, 214, 222, 224, and 116 are fed to the reactors in a downflow mode.

As shown in FIG. 1, the size of the catalyst beds increase from first catalyst bed 210 to second catalyst bed 220 and from second catalyst bed 220 to final catalyst bed 230. Although not drawn to scale, the size increase is meant to convey the increase in catalyst bed volume for each succeeding catalyst bed in the two-phase hydroprocessing zone.

EXAMPLES

Analytical Methods and Terms

All ASTM Standards are available from ASTM International, West Conshohocken, Pa., www.astm.org.

Amounts of sulfur, nitrogen and basic nitrogen are provided in parts per million by weight, wppm.

Total Sulfur was measured using two methods, namely ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D5186-03 (2009), "Standard Test Method for Determination of Aromatic Content and Polynuclear Aromatic Content of Diesel Fuels and Aviation Turbine Fuels by Supercritical Fluid Chromatography", DOI: 10.1520/D5186-03R09.

Boiling range distribution was determined using ASTM D2887 (2008), "Standard Test Method for Boiling Range Distribution of Petroleum Fractions by Gas Chromatography," DOI: 10.1520/D2887-08.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

Bromine Number is a measure of aliphatic unsaturation in petroleum samples. Bromine Number was determined using ASTM Standard D1159, 2007, "Standard Test Method for Bromine Numbers of Petroleum Distillates and Commercial Aliphatic Olefins by Electrometric Titration," DOI: 10.1520/D1159-07.

Cetane index is a useful calculation to estimate the cetane number (measure of combustion quality of a diesel fuel) of a diesel fuel when a test engine is not available or if sample size is too small to determine this property directly. Cetane index is determined using ASTM Standard D4737 (2009a), "Standard Test Method for Calculated Cetane Index by Four Variable Equation," DOI: 10.1520/D4737-09a.

"LHSV" means liquid hourly space velocity, which is the volumetric rate of the liquid feed divided by the volume of the catalyst, and is given in $hr^{-1}$.

Refractive Index (RI) was determined using ASTM Standard D1218 (2007), "Standard Test Method for Refractive Index and Refractive Dispersion of Hydrocarbon Liquids," DOI: 10.1520/D1218-02R07.

"WABT" means weighted average bed temperature.

The following examples are presented to illustrate specific embodiments of the present invention and not to be considered in any way as limiting the scope of the invention.

Example 1

A middle distillate blend (MD) feed sample, having the properties shown in Table 1, was hydroprocessed in an experimental pilot unit containing a set of three liquid-full reactors (LFRs, individually, R1, R2, and R3) followed by a conventional trickle bed reactor (TBR), arranged sequentially, all in series. The two-phase hydroprocessing zone in all Examples is the first two-phase hydroprocessing zone with liquid recycle. The feed sample was obtained by mixing two heavy straight run diesel (HSRD) samples, a light cycle oil (LCO) sample from a fluid catalytic cracking (FCC) unit, and a LCO sample from a Resid FCC unit, all from a commercial refinery.

The three liquid-full reactors were in series with a single liquid recycle stream and the TBR had no liquid recycle. Hydrogen feed to the TBR was approximately 5 times the amount consumed. The excess hydrogen from the TBR would normally be recirculated around a commercial TBR but was not circulated in this Example 1.

Liquid feed, recycle stream and hydrogen were fed in an upflow mode to the reactors. It is noted that commercial reactors typically employ downflow mode for all these.

TABLE 1

Properties of the MD Feed for Examples 1 through 5

| Property | Unit | Value |
|---|---|---|
| Total Sulfur | wppm | 14130 |
| Total Nitrogen | wppm | 459 |
| Refractive Index (20° C.) | | 1.5159 |
| Density at 15.5° C. (60° F.) | g/ml | 0.9085 |
| API Gravity | | 24.1 |
| Bromine No. | g/100 g | 4.2 |
| Monoaromatics | wt. % | 18.1 |
| Polyaromatics | wt. % | 30.1 |
| Total Aromatics | wt. % | 48.2 |
| Cetane Index | | 35.3 |
| Cloud Point/Pour Point | ° C./° C. | 4/−4 |
| Boiling Point | % | ° C. |
| IBP = Initial boiling point | IBP | 124 |
| | 5 | 207 |
| | 10 | 230 |
| | 20 | 258 |
| | 30 | 271 |
| | 40 | 283 |
| | 50 | 292 |
| | 60 | 301 |
| | 70 | 310 |
| | 80 | 322 |
| | 90 | 338 |
| | 95 | 350 |
| | 99 | 374 |
| FBP = Final boiling point | FBP | 386 |

Each LFR was constructed of 316L stainless steel tubing in 19 mm (¾") OD and about 49 cm (19¼") in length with reducers to 6 mm (¼") diameter on each end. The TBR was 122 cm (48") long, otherwise identical to the LFRs. Both ends of the reactors were first capped with metal screen to prevent catalyst leakage. Below the metal mesh, the reactors were packed with a layer of 1 mm glass beads at both ends. A desired volume of the catalyst was packed in the mid-section of the reactor.

R1, R2, and R3 contained 7 ml, 28 ml, and 37 ml, respectively, of a hydrotreating catalyst. The catalyst, KF-860-1.3Q was of Ni—Mo on $\gamma$-$Al_2O_3$ from Albemarle Corp., Baton Rouge, La. KF-860 consisted of quadralobes of 1.3 mm diameter and about 10 mm long. The conventional TBR reactor contained 93 ml of the same KF-860-1.3Q catalyst.

Each LFR was placed in a temperature-controlled sand bath, consisting of a 120 cm long (180 cm long for TBR) steel pipe filled with fine sand having 8.9 cm OD (3" Nominal, Schedule 40). Temperatures were monitored at the inlet and outlet of each reactor. Temperature at the inlet and outlet of each reactor were controlled using separate heat tapes wrapped around the 8.9 cm OD sand bath. The sand bath pipe for the TBR contained three independent heat tapes.

The hydrotreating catalyst (a total of 72 ml for the LFRs and 93 ml for the TBR) was charged to the reactors and was dried overnight at 115° C. under a total flow of 400 standard cubic centimeters per minute (sccm) of hydrogen gas. The reactors were heated to 176° C. with flow of charcoal lighter fluid (CLF) through the catalyst beds. Sulfur spiked-CLF (1 wt % sulfur, added as 1-dodecanethiol) and hydrogen gas were passed through the reactors at 176° C. to pre-sulfide the catalysts. The pressure was 6.9 MPa (1000 psig or 69 bar).

The temperature of the reactors was increased gradually to 320° C. Pre-sulfiding was continued at 320° C. until breakthrough of hydrogen sulfide ($H_2S$) was observed at the outlet of the TBR.

After pre-sulfiding, the catalysts were stabilized by flowing a straight run diesel (SRD) through the catalysts in the reactors at a temperature varying from 320° C. to 355° C. and at pressure of 6.9 MPa (1000 psig or 69 bar) for approximately 10 hours.

After pre-sulfiding and stabilizing the catalyst with SRD at a pressure of (6.9 MPa), the temperatures in the LFRs (WABT) were adjusted to 354° C., 357° C., and 363° C., respectively in R1, R2, and R3. The temperature of the TBR was adjusted to 366° C. The positive displacement feed pump was adjusted to a flow rate of 3.86 ml/minute for a liquid-full hydrotreating LHSV of 3.2 $hr^{-1}$, for a TBR hydrotreating LHSV of 2.5 $hr^{-1}$, and an overall LHSV of 1.4 $hr^{-1}$. The total hydrogen feed rate to the LFRs was 152 normal liters of hydrogen gas per liter of fresh hydrocarbon feed (N l/l) (854 scf/bbl), based on the fresh MD feed. The total hydrogen feed to TBR was 412 Nl/l (2313 scf/bbl), again based on the fresh MD feed. The pressure was nominally 13.4 MPa (1940 psia, 134 bar) in the two-phase hydroprocessing zone and 10.2 MPa (1475 psia, 102 bar) in the three-phase hydroprocessing zone.

The recycle ratio was 2.5 for the two-phase hydroprocessing zone. The reactors were maintained under the above conditions for at least 24 hours to achieve steady state so that the catalyst was fully precoked and the system was lined-out with the MD feed while testing for total sulfur, nitrogen and density.

Hydrogen was fed from compressed gas cylinders and the flow was measured using dedicated mass flow controllers. In the two-phase hydroprocessing zone, hydrogen gas was mixed with the MD feed stream and a portion of the product effluent from R3, as diluent recycle stream, in a 6 mm OD 316L stainless steel tubing ahead of each reactor. The fresh MD feed/hydrogen/diluent was preheated in the 6-mm OD tubing in the temperature controlled sand bath in a down-flow mode and was then introduced to R1 in an up-flow mode.

After exiting R1, additional hydrogen was dissolved in the product effluent of R1 (feed to R2). The feed to R2 was again preheated in a 6-mm OD tubing and flowed downward through a second temperature-controlled sand bath before being introduced to R2 in an up-flow mode.

After exiting R2, additional hydrogen was dissolved in the product effluent of R2 (feed to R3). The feed to R3 was again preheated in a 6-mm OD tubing and flowed downward through the second temperature-controlled sand bath before being introduced into R3 in an up-flow mode.

The product effluent from R3 was split into a liquid recycle stream (for use as diluent) and a final product effluent from the two-phase hydroprocessing zone. The liquid recycle stream flowed through a piston metering pump, to join a fresh MD feed at the inlet of R1. The liquid recycle stream served as diluent in this Example.

The final product effluent from the two-phase hydroprocessing zone was discharged into the three-phase hydroprocessing zone through a control valve. A pressure difference of 3.2 MPa (465 psi, 32 bar) was maintained between the two sections (two-phase LFR and three-phase TBR). Since pure hydrogen is used in these laboratory experiments, in order to mimic the lower partial pressure of hydrogen in the hydrogen-containing gas that would be supplied to the TBR in commercial operation, a lower pressure was used in the TBR in these Examples. More specifically, in a commercial operation, at least a portion of the hydrogen-containing gas fed to the TBR is a hydrogen-rich recycle gas steam, which has a lower partial pressure of hydrogen due to accumulation of volatiles such as methane, in the hydrogen-rich recycle gas stream.

The final product effluent from the two-phase hydroprocessing zone was mixed with hydrogen, which was dissolved in the final product effluent prior to introducing into the TBR, which was a single liquid-pass catalyst bed outside any liquid recycle stream. The trickle bed product effluent was then flashed, cooled, and separated into gas and liquid product streams.

A total liquid product (TLP) sample and an off-gas sample were collected for this and each Example under steady state conditions. The feed and product flow rates, as well as the hydrogen gas feed rate and the off-gas flow rate were measured. The sulfur and nitrogen contents were measured in the TLP sample and overall material balances were calculated by using a GC-FID to account for light ends in the off-gas. Results for Example 1 are shown in Table 2.

From the total hydrogen feed and hydrogen in the off-gas, the hydrogen consumption was calculated to be 193.4 Nl/l (1,086 scf/bbl) for Example 1.

In Example 1, the sulfur and nitrogen contents of the TLP sample were 9 ppm and 0 ppm, respectively. (Nitrogen was below detectability limits of the method used.) The density at 15.6° C. (60° F.) of TLP sample was 856 kg/$m^3$ yielding an API gravity of 33.6. The cetane index was calculated to be 46.9, an increase of about 12 relative to the feed. The cetane index increase reflects the corresponding cetane number increase.

Examples 2-5

Examples 2 to 5 were conducted under similar conditions to those in Example 1, with the following exceptions. In Example 2, fresh MD feed flow rate was increased from 3.86 to 4.5 ml/min (corresponding to an increase in LHSV from 3.2 to 3.8 $hr^{-1}$ in the LFR and 2.5 to 2.9 $hr^{-1}$ in the TBR). In Example 3, the pressure of the LFR and TBR were both kept constant at 11.1 MPa (1615 psia, 111 bar). In Example 4, both LFR and TBR were kept at the same pressure of 11.8 MPa (1715 psia, 118 bar). In Example 5, the conditions of Example 4 were used, except the temperature of TBR was increased to 374° C. from 366° C. Conditions and results for Examples 1 to 5 are shown in Table 2. The recycle ration (RR) for all Examples 1-5 was 2.5.

TABLE 2

Summary for Examples 1 to 5

| Example | LHSV, $hr^{-1}$ LFR/TBR | Press. MPa LFR/TBR | React. Temp., ° C. R1/R2/R3/TBR | Density$^{15° C.}$ kg/$m^3$ | S wppm | N wppm | Cetane Index | $H_2$ Consump. Nl/l | Mono A | Poly A | Total A |
|---|---|---|---|---|---|---|---|---|---|---|---|
| Feed | | | | 910 | 14130 | 459 | 35.3 | | 18.1 | 30.1 | 48.2 |
| 1 | 3.2/2.5 | 13.4/10.2 | 354/357/363/366 | 856 | 9 | 0 | 46.9 | 193.4 | 23.2 | 2.5 | 25.7 |

TABLE 2-continued

Summary for Examples 1 to 5

| Example | LHSV, $hr^{-1}$ LFR/TBR | Press. MPa LFR/TBR | React. Temp., ° C. R1/R2/R3/TBR | Density$^{15° C.}$ $kg/m^3$ | S wppm | N wppm | Cetane Index | $H_2$ Consump. NI/l | Mono A | Poly A | Total A |
|---|---|---|---|---|---|---|---|---|---|---|---|
| 2 | 3.8/2.9 | 13.4/10.2 | 354/357/363/366 | 858 | 16 | 0 | 45.9 | 189.7 | 25.0 | 3.2 | 28.2 |
| 3 | 3.2/2.5 | 11.1/11.1 | 354/357/363/366 | 857 | 10 | 0 | 46.5 | 201.8 | 23.9 | 2.4 | 26.3 |
| 4 | 3.2/2.5 | 11.8/11.8 | 354/357/363/366 | 855 | 8 | 0 | 46.8 | 213.9 | 21.7 | 2.0 | 23.7 |
| 5 | 3.2/2.5 | 11.8/11.8 | 354/357/363/374 | 853 | 7 | 0 | 48.4 | 214.8 | 21.0 | 1.9 | 22.9 |

LFR is liquid-full reactors.
TBR is trickle-bed reactor.
Mono A is Monoaromatics.
Poly A is Polyaromatics.
Total A is Total Aromatics.

Results in Table 2 show that increasing the severity of the reaction (lower LHSV, higher pressure, and higher reactor temperature) decreases the sulfur content in the TLP (total liquid product), lowers the TLP density, and increases the hydrogen consumption. Product sulfur is 9 wppm in Example 1 to and 16 wppm in Example 2 (at higher LHSV relative to Example 1); 10 wppm in Example 3 (lower LFR pressure than Example 1); 8 wppm in Example 4 (higher TBR pressure than Example 1); and 7 wppm in Example 5 (higher pressure and temperature in TBR than in Example 1). Similar effects are seen in product density.

Nitrogen content is below the detection limit of the ASTM method of about 1 ppm, so that essentially a complete nitrogen removal is observed in all the Examples, reported as "0".

Hydrogen consumption also increases as the severity of conditions is increased, due mainly to aromatic saturation. Increased hydrogen consumption corresponds to greater aromatic saturation—that is, content of aromatics decreases with (is inversely related to) hydrogen consumption.

The results show that using liquid full reactor beds upstream of a conventional TBR in a pre-treatment mode is unexpectedly advantageous as the combination creates a high overall conversion in terms of sulfur or nitrogen removal, density reduction, and cetane number increase.

Comparative Examples A through E

The same middle distillate (MD) sample used in Examples 1-5 was hydroprocessed in Comparative Examples A through E under similar conditions to those in Example 1, with the following exceptions. In Comparative Examples A through D, the reactor configuration described in Example 1 was used except that the Comparative Examples A through D were conducted without a three-phase trickle bed reactor (TBR). Comparative Example E was conducted using only a three-phase TBR that contained 90 mL of the KF-860 catalyst.

In Comparative Example A, after loading, drying, presulfiding, and stabilizing the catalyst, the reactor bed temperature was adjusted to 357° C. in R1, R2, and R3 with a fresh MD flow rate of 4.5 ml/min (LHSV of 3.8 $hr^{-1}$); total $H_2$ feed flow rate was 133.6 l/l (750 scf/bbl), and recycle ratio was 2.5. Pressure was kept constant at 13.4 MPa (1925 psig, 134 bar).

R1, R2, and R3 were maintained under these conditions for 12 hours to pre-coke the catalyst and to line out the system. TLP and off-gas samples were collected. Reaction conditions and results for Comparative Examples A-E are shown Table 3.

Comparative Examples A and B show a process in which there is no TBR. The two-phase hydroprocessing zone was the same as described in Examples 1 through 5. In Comparative Example A, the temperature was kept constant in all three LFRs (two-phase reactors) at 357° C. In Comparative Example B, the temperature in all three LFRs was 366° C. The sulfur contents in product samples collected were 1,200 ppm and 600 ppm in Comparative Examples A and B, respectively.

In Examples 1, 3, 4, and 5 above, overall LHSV was constant at 1.4 $hr^{-1}$. This LHSV of 1.4 $hr^{-1}$ was used in Comparative Examples C and D where only three of the LFRs were used. Temperatures used in Examples 1, 3, 4, and 5 were also used in Comparative Examples C and D. The liquid recycle ratio (RR) was 4.0 in Comparative Example C whereas liquid RR was 2.5 in Comparative Example D. The sulfur contents of the products were 220 ppm and 104 ppm, in Comparative Examples C and D, respectively.

Comparative Example E was conducted using only a three-phase (TBR) laboratory reactor. Again, the LHSV was kept at 1.4 $hr^{-1}$ for a direct comparison with the experiments conducted in Examples 1, 3, 4, and 5. The sulfur content of TLP in Comparative Example E was 19 ppm.

Results for Comparative Examples A through E are provided in Table 3. Results for Examples 1 through 5 are provided in Table 2. Comparison of these results shows that the process of this invention (two-phase reactors upstream of three-phase reactors) provides superior results in terms of density, sulfur and nitrogen removal, and cetane index (which can be correlated with cetane number), relative to using only LFRs (two-phase reactors) or TBRs (three-phase reactors), under otherwise equivalent process conditions (temperature, pressure, and LHSV). The results shown in Tables 2 and 3 thus illustrate clearly that the efficacy of the LFRs can be increased when they are used upstream of three-phase reactors.

Conversion of sulfur is increased significantly, (see Comparative Example E) which makes the hydroprocessing process of this invention here a more competitive option than use of either LFRs or a TBRs alone.

Thus, comparison of the results of Examples 1-5 with those of Comparative Examples A-E illustrates the utility and advantages of the hydroprocessing process of this invention.

Comparison of results of Examples 1-5 with those of Comparative Examples A-E further illustrates that the use of liquid-full reactors upstream from a TBR improves the properties of a middle distillate beyond the properties that can be achieved using only one reactor system.

Thus, Examples 1-5 and Comparative Examples A-E illustrate an unexpected synergy of using liquid-full reactors as pre-treatment vehicles for TBR reactors.

TABLE 3

Summary for Comparative Examples A to E

| Example | LHSV, $hr^{-1}$ LFR/TBR | Press. MPa LFR/TBR | React. Temp., ° C. R1/R2/R3/TBR | RR | Density$^{15°\ C.}$ $kg/m^3$ | S wppm | N wppm | Cetane Index | $H_2$ Consump. NI/l |
|---|---|---|---|---|---|---|---|---|---|
| Feed | | | | | 910 | 14130 | 459 | 35.3 | |
| A | 3.8/N.A | 13.4/N.A. | 357/357/357/N.A. | 2.5 | 877 | 1200 | 5 | 45.5 | 116 |
| B | 3.8/N.A. | 13.4/N.A. | 366/366/366/N.A. | 2.5 | 871 | 600 | 2 | 44.9 | 134 |
| C | 1.4/N.A | 13.4/N.A. | 354/357/363/N.A. | 4.0 | 867 | 220 | 0 | 45.9 | 158 |
| D | 1.4/N.A | 13.4/N.A. | 354/357/363/N.A. | 2.5 | 860 | 104 | 0 | 45.7 | 166 |
| E | N.A./1.4 | N.A./10.2 | N.A/N.A/N.A/360 | N.A. | 844 | 19 | 0 | 51.1 | 250 |

RR is recycle ratio.
LFR is liquid-full reactor.
TBR is trickle-bed reactor.
N.A. means not applicable

What is claimed is:

1. A process for hydroprocessing a hydrocarbon feed which comprises:

(a) providing a first two-phase hydroprocessing zone in sequence and in liquid communication with a three-phase hydroprocessing zone, wherein the two-phase hydroprocessing zone comprises a liquid recycle and at least two catalyst beds disposed in sequence and in liquid communication, wherein each catalyst bed is disposed in a liquid-full reactor and contains a catalyst having a volume, the catalyst volume increasing in each succeeding bed; the three-phase hydroprocessing zone comprises a single-liquid pass catalyst bed disposed in a trickle bed reactor, wherein the single-liquid-pass catalyst bed is outside any liquid recycle stream;

(b) contacting a hydrocarbon feed with (i) a diluent and (ii) hydrogen to produce a hydrocarbon feed/diluent/hydrogen mixture, wherein hydrogen is dissolved in the mixture to provide a liquid feed;

(c) contacting the liquid feed with a first catalyst in a first catalyst bed of the first two-phase hydroprocessing zone to produce a product effluent;

(d) contacting the product effluent from a preceding catalyst bed with a current catalyst in a current catalyst bed of the first two-phase hydroprocessing zone, wherein the preceding catalyst bed is immediately upstream of and in liquid communication with the current catalyst bed to produce a current product effluent, such that when the preceding catalyst bed is the first catalyst bed, the product effluent from the preceding catalyst bed is the product effluent from the first catalyst bed, produced in step (c);

(e) recycling a portion of the current product effluent from a final catalyst bed of the first two-phase hydroprocessing zone as the liquid recycle for use in the diluent in step (b) at a recycle ratio of from about 0.1 to about 10, wherein the final catalyst bed contains a final catalyst and is a current catalyst bed having no succeeding catalyst bed in the first two-phase hydroprocessing zone;

(f) contacting hydrogen and the remaining portion of the current product effluent from the final catalyst bed of the first two-phase hydroprocessing zone with one or more catalysts in one or more single-liquid-pass catalyst beds, wherein each single-liquid-pass catalyst bed in this step (f) is disposed in (i) a liquid-full reactor in a second two-phase hydroprocessing zone, or (ii) a trickle bed reactor in the three-phase hydroprocessing zone to produce a product effluent, provided that when the remaining portion of the current product effluent is contacted with a catalyst in a single-liquid-pass catalyst bed disposed in a liquid-full reactor, there is a further step comprising:

(f') contacting the product effluent from the single-liquid-pass catalyst bed disposed in a liquid-full reactor and a hydrogen-containing gas with a catalyst in a single-liquid-pass catalyst bed disposed in a trickle bed reactor in the three-phase hydroprocessing zone;

and further provided that when the single-liquid-pass catalyst bed is disposed in a trickle bed reactor, the hydrogen is provided as a hydrogen-containing gas wherein at least a portion of the hydrogen-containing gas is a hydrogen-rich recycle gas stream and wherein the hydrogen-containing gas is added in an amount sufficient to maintain a continuous gas phase in the trickle bed reactor and the product effluent is a trickle bed product effluent; and (g) directing the trickle bed effluent to a separator to produce the hydrogen-rich recycle gas stream for use in step (f) or (f') and a liquid product.

2. The process of claim 1, further comprises repeating step (d) is repeated one or more times.

3. The process of claim 2 wherein step (d) is repeated one to nine times.

4. The process of claim 3, wherein a ratio of the volume of the first catalyst to the volume of the final catalyst is in the range of about 1:1.1 to about 1:20.

5. The process of claim 3 wherein the catalyst volume is distributed among the catalyst beds of the first two-phase hydroprocessing zone in a way such that the hydrogen consumption for each catalyst bed is within a range of ±10% by volume of hydrogen.

6. The process of claim 4 wherein the catalyst volume is distributed among the catalyst beds of the first two-phase hydroprocessing zone in a way such that the hydrogen consumption for each catalyst bed is within a range of ±10% by volume of hydrogen.

7. The process of claim 1, wherein hydrogen is fed to a location between each of a set of preceding and current catalyst beds in the first two-phase hydroprocessing zone.

8. The process of claim 6, wherein hydrogen is fed to a location between each of a set of preceding and current catalyst beds in the first two-phase hydroprocessing zone.

9. The process of claim 8 wherein the recycle ratio is from about 0.5 to about 6.

10. The process of claim 1 wherein the three-phase hydroprocessing zone comprises two or more single-liquid pass catalyst bed disposed in one or more trickle bed reactors.

11. The process of claim 1 wherein, in step (f), hydrogen and the remaining portion of the current product effluent from the final catalyst bed of the first two-phase hydroprocessing zone are contacted with one or more catalysts in one or more single-liquid-pass catalyst beds, wherein each single-liquid-pass catalyst bed in this step (f) is disposed in a liquid-full reactor in a second two-phase hydroprocessing zone.

12. The process of claim 1 wherein, in step (f), hydrogen and the remaining portion of the current product effluent from the final catalyst bed of the first two-phase hydroprocessing zone is contacted with one or more catalysts in one or more single-liquid-pass catalyst beds, wherein each single-liquid-pass catalyst bed in this step (f) is disposed in (ii) a trickle bed reactor in a three-phase hydroprocessing zone.

13. The process of claim 1, wherein the hydrocarbon feed is selected from the group consisting of jet fuel, kerosene, straight run diesel, light cycle oil, light coker gas oil, gas oil, heavy cycle oil, heavy coker gas oil, heavy gas oil, resid, deasphalted oil, and combinations of two or more thereof.

14. The process of claim 1 wherein the hydrocarbon feed is a middle distillate.

15. The process of claim 1, wherein the first two-phase hydroprocessing zone operates at a pressure higher than the pressure of the three-phase hydroprocessing zone.

16. The process of claim 1, wherein at least one catalyst of the two-phase hydroprocessing zone is a hydrotreating catalyst.

17. The process of claim 1, further comprising sulfiding the catalysts of both the two phase and the three-phase hydroprocessing zones by contacting the catalysts with a sulfur-containing compound.

18. The process of claim 1, wherein the total amount of hydrogen fed to the two-phase hydroprocessing zone is from about 17.81 l/l to about 445.25 l/l, and the total amount of hydrogen fed to the three-phase hydroprocessing zone is from about 89.05 l/l to about 890.5 l/l.

19. The process of claim 8 wherein the three-phase hydroprocessing zone comprises two or more single-liquid pass catalyst bed disposed in one or more trickle bed reactors, the hydrocarbon feed is a middle distillate, the first two-phase hydroprocessing zone and, provided that when the remaining portion of the current product effluent is contacted with a catalyst in a single-liquid-pass catalyst bed disposed in a liquid-full reactor, the second two-phase hydroprocessing zone operate at a pressure higher than the pressure of the three-phase hydroprocessing zone.

20. The process of claim 19 wherein at least one catalyst of the two-phase hydroprocessing zone is a hydrotreating catalyst and the process further comprising sulfiding the catalysts of both the two phase and the three-phase hydroprocessing zones by contacting the catalysts with a sulfur-containing compound.

* * * * *